US005211510A

United States Patent [19]

Kimura et al.

[11] Patent Number: 5,211,510

[45] Date of Patent: May 18, 1993

[54] PROPULSION METHOD OF PIPE TO BE BURIED WITHOUT SOIL DISCHARGE AND AN EXCAVATOR

[75] Inventors: Koichi Kimura, Hyogo; Hiroharu Nishida, Osaka, both of Japan

[73] Assignee: Kidoh Construction Co., Ltd., Osaka, Japan

[21] Appl. No.: 803,884

[22] Filed: Dec. 9, 1991

[30] Foreign Application Priority Data

Dec. 12, 1990 [JP] Japan ..... 2-401711
Jan. 17, 1991 [JP] Japan ..... 3-004057

[51] Int. Cl.[5] ..... F16L 1/028; E21D 9/08

[52] U.S. Cl. ..... 405/184; 405/146; 175/62

[58] Field of Search ..... 405/138, 144, 154, 184, 405/146; 175/62

[56] References Cited

U.S. PATENT DOCUMENTS 4,673,312 6/1987 Nussbaumer ..... 405/184
4,936,709 6/1990 Kimura ..... 405/184

FOREIGN PATENT DOCUMENTS 0345945 5/1989 European Pat. Off. .
61-102999 5/1986 Japan .
2-144498 6/1990 Japan .
3-47396 2/1991 Japan .

*Primary Examiner*—David H. Corbin
*Attorney, Agent, or Firm*—Armstrong, Westerman, Hattori, McLeland & Naughton

[57] ABSTRACT

A propulsion method of a pipe to be buried without soil discharge comprising the steps of drilling the ground with the tip of an excavator propelling in the ground, taking the drilled soil into the excavator, discharging the taken soil to the ground side by compacting the soil on the outer circumference of the excavator, and burying the pipe progressively in the hole formed behind the excavator; being characterized in using an excavator equipped with a tip part having a diameter larger than the outside diameter of the pipe to be buried and a rear part having nearly the same diameter as the outside diameter of the pipe to be buried.

3 Claims, 7 Drawing Sheets

PROPULSION METHOD OF PIPE TO BE BURIED WITHOUT SOIL DISCHARGE AND AN EXCAVATOR

BACKGROUND OF THE INVENTION

The present invention relates to a propulsion method of a pipe to be buried without soil discharge and to an excavator, and more particularly relates to a propulsion method without soil discharge capable of burying pipes progressively into a formed burying hole while drilling and forming a burying hole in the ground, without excavating the ground surface, when installing an underground pipe of sewer or the like, while treating the excavated soil inside the ground without discharging outside, and relates to an excavator for excavating a tunnel of a relatively small aperture in the ground, which is applied in said propulsion method.

As one of the propulsion methods of a pipe to be buried underground, the process of burying pipes progressively as the excavator having a drilling mechanism such as auger at the tip drills a burying hole in the ground and goes on excavating is known, and it is generally called the auger process.

In the auger process, usually, the soil excavated by the excavator is conveyed backward through the inside of the pipe row being propelled and buried, is brought up to the shaft or ground surface from the rear end of the pipe row to be buried, and is discarded. In this method, however, it is necessary to install a soil conveying mechanism inside the narrow burying hole from the excavator till the rear end of the pipe row to be buried, and the equipment is complicated, and the facility cost and running cost are high, and the propulsion speed of the excavator must be set by adjusting to the soil conveying capacity, and therefore the propulsion speed cannot be set so high, and it also takes labor and cost, among other problems, for discarding the excavated soil as refuse.

Accordingly in the case of a pipe to be buried of a relatively small diameter, the propulsion method without soil removal is employed, that is, the excavated soil is treated inside the burying hole and is not discharged outside. More specifically, a leading element shaped like cone etc. is pressed into the ground to form a burying hole. The soil put aside to the outer circumference by the leading element is compacted in the inner wall of the burying hole or the ground side, and therefore the burying hole may be formed without discharging the soil outside. Practical propulsion methods without soil removal are known to include the impact injection method by compressed air and injection method by hydraulic jack. In these methods, however, there is a very large resistance in injecting the leading element into the ground, and an extremely large propulsive force must be applied to the leading element. Accordingly, the facility of the jack for applying the propulsive force is increased in size, and a greater power is required in operation.

As a process without soil discharge to solve the above problems, the following process has been proposed. In this process, an excavating mechanism such as auger is attached to the tip of the leading element, and by this leading element of the excavator the ground on the front side of the excavator is drilled to form a burying hole corresponding to the outside diameter of the excavator, and the removed soil is once taken into the excavator, and the taken soil is forced out in the radial direction from the soil discharge port opened on the outer circumference of the excavator behind the excavator, and is compacted to the ground side from the inner wall of the burying hole. In this process, since the ground is first drilled by the excavator and the removed soil is compacted to the outer circumferential ground, as compared with the conventional process of injecting the leading element by force into the ground, the resistance in the axial direction is small, and it is possible to propel even with a relatively small propulsive force. In this process, moreover, a conical cone rotor rotating eccentrically is incorporated inside the excavator, and by forcing out the soil in the radial direction from the soil discharge port by the radial force due to the eccentric rotation of the cone rotor, it is also proposed to compact the soil to the ground side efficiently.

According to this improved propulsion method without soil charge, it is possible to bury pipes progressively at lower cost and more efficiently.

Even in the improved propulsion method without soil discharge, however, as the aperture of the pipe to be buried becomes larger, it is difficult to propel the excavator and the pipe row, and it cannot be applied to wide aperture pipes.

That is, in the process without soil discharge, as the aperture of the pipe to be buried becomes larger, the ground drilling diameter by the excavator is wider, and a massive soil of large drilling diameter must be compacted to the ground outside the excavator, and as the soil compaction volume increases, the resistance in propulsion increases, and a greater propulsive power is required, and if exceeding the tolerance of the compaction determined by the ground soil quality, it is no longer possible to compact, and propulsion is disabled.

This problem is explained in detail. As shown in FIG. 4, when burying a pipe with an outside diameter D, the soil in a range corresponding to the sectional area of $\pi D^2/4$ must be completely compacted and discharged to the ground side. From the ground soil condition and the sideway compression capacity of the excavator, supposing the distance capable of compressing and expanding the inner wall of the burying hole to the outer circumference side in the ground section, that is, the possible compaction depth to be t, $$\pi(D+2t)^2/4-\pi D^2/4 \quad (1)$$

is the gap that can be formed by sideway compression, that is, the sectional area of the space in which the soil can be accommodated, and the soil in the range corresponding to the sectional area of the outside diameter of the pipe to be buried must be discharged within this sectional area. In this case, assuming the volume decrease rate due to compaction of excavated soil to be $\alpha$, the soil in a range corresponding to the sectional area of $$(1-\alpha)\pi D^2/4 \quad (2)$$

must be completely taken into the gap sectional area stated above. Accordingly, the following limit is applied to the inside diameter of the burying hole, that is, the outside diameter D of the pipe to be buried progressively.

$$(1-\alpha)\pi D^2/4 \leqq \pi(D+2)^2/4-\pi D^2/4 \quad (3)$$

That is, $$D \leqq \{2/[(2-\alpha)^{0.5}-1)]\}t \quad (4)$$

In other words, the outside diameter D of the pipe that can be propelled and buried without discharging soil is, supposing the sideway compression depth to be t and the volume decrease rate by compaction of excavated soil to be $\alpha$, possible up to $\{2/[(2-\alpha)^{0.5}-1]\}t$.

For example, in the general condition of conventional propulsion method without soil discharge, i.e., t=5 cm, $\alpha$=0.1 (10%), a pipe of up to 26.4 cm in outside diameter D can be buried without soil discharge, but a wider pipe cannot be installed in the same process. If the compaction capacity is raised by using the eccentric rotation cone rotor to achieve t=5 cm, $\alpha$=0.15, the maximum limit is D =44.6 cm as estimated from the above formula. In other words, in the case of pipes with medium or large diameter in which the excavated soil volume is large, its disposal cost occupies a large portion of the installation cost, and the merits of process without soil discharge are great, the propulsion method without soil discharge can be indeed rarely applied.

SUMMARY OF THE INVENTION

It is hence a primary object of the present invention to present a propulsion method of a pipe to be buried without soil discharge to be favorably applied to pipes of medium and large diameters by solving the problems of the limitation of applicable diameter in the conventional method without soil discharge and an excavator used in said propulsion method.

To solve the above problems, the present invention presents a propulsion method of a pipe to be buried without soil discharge which comprises the steps of drilling the ground with the tip of an excavator propelling in the ground, taking the drilled soil into the excavator, discharging the taken soil to the ground side by compacting the soil on the outer circumference of the excavator, and burying the pipe progressively in the hole formed behind the excavator; being characterized in that using an excavator equipped with a tip part having a diameter larger than the outside diameter of the pipe to be buried and a rear part having nearly the same diameter as the outside diameter of the pipe to be buried, the ground is drilled by a diameter larger than the outside diameter of the pipe, and in that at least a part of the soil taken into the excavator is discharged outside of the excavator in a rear position than the tip large diameter part of the excavator.

The basic structure of the excavator is similar to the one used in the propulsion method without soil discharge accompanied by drilling of the ground in the prior art. The head of the excavator is furnished with an excavating mechanism having a tool or cutter for drilling the ground. The excavating mechanism comprises a driving mechanism such as electric motor and hydropneumatic motor. The drilling diameter of the excavating mechanism is set nearly equal or smaller than the outside diameter of the tip large diameter part forming the front part of the excavator. The outside diameter of the tip large diameter part of the excavator and the drilling diameter of the excavating mechanism are set larger than the outside diameter of the pipe to be buried. The outside diameter of the tip large diameter part and the drilling diameter are determined by the soil property, compaction capacity of the excavator, the outside diameter of the pipe and other installation conditions. The soil removed from the ground by the excavating mechanism is taken into the excavator and sent backward.

The rear part of the excavator is smaller in outside diameter than said tip large diameter part, and is nearly same in outside diameter as that of the pipe to be buried, and therefore there is a step difference between the tip large diameter part and the rear part of the excavator. The pipes to be buried are sequentially linked to the rear part of the excavator, and the pipes are propelled and buried progressively as the excavator propels.

The soil excavated by the excavating mechanism and sent to the rear side of the excavator is discharged to the outer circumference of the excavator at a position behind the tip large diameter part. That is, in the vertical wall part of the step difference formed due to difference in outside diameter between the tip large diameter part and the rear part, the soil is discharged from the axial soil discharge port opened behind in the axial direction of the excavator or from the rear soil discharge port opened outside in the rear part of the excavator. The axial soil discharge port may be directed exactly in the same axial direction of the excavator, or may be inclined in the axial direction obliquely to the outside. The rear soil discharge port may be directed in the radial direction of the excavator or be inclined obliquely backward. The axial and rear soil discharge ports may be continuously annular over the entire circumference of the excavator, or a plurality of discharge ports may be disposed at intervals in the circumferential direction. Meanwhile, similarly to a conventional excavator, the excavator may also be provided with the outermost soil discharge ports opened in the radial direction on the outer circumference of the tip large diameter part at the outermost circumference of the excavator together with the axial discharge ports or rear discharge ports.

The soil discharged behind the tip large diameter part of the excavating machine is compacted to the ground side to form an inner wall of the burying hole, and a pipe is installed in this burying hole.

In the soil passing part inside the excavator, a cone rotor may be incorporated. The cone rotor has an approximately conical form in which its front side located behind the excavating mechanism is pointed and the rear outer end is disposed near the soil discharge port. The cone rotor is rotated by a driving mechanism same as that of the excavating mechanism such as motor. The cone rotor may be only simply rotated, but is preferred to be eccentrically rotated by a central shaft of the cone rotor being installed slightly eccentrically from the rotary shaft of the driving mechanism. As the cone rotor rotates eccentrically, the soil is stirred and ground and sent to the rear outer side along the conical contour of the cone rotor, so that the soil may be discharged while applying a strong pressure to the ground side from the soil discharge port. That is, the cone rotor eccentrically rotating has a superior compacting function. The outer wall structure of the cone rotor is composed of a material capable of withstanding the impact of soil and pebbles, and may be provided with projections or undulations for crushing pebbles and stones.

Instead of the cone rotor, compacting plates operated by hydraulic cylinder or the like may be arranged on the circumference in the soil passage, and each compacting plate may be actuated in the radial direction to force out the soil to the outer circumference so that the compacting action on the ground side may be reinforced. Besides, it is also preferable to have a mechanism for efficiently compacting the soil to the ground side.

The excavator may be provided with various mechanisms as used in ordinary excavators, besides the structure above, such as direction control mechanism for controlling the propulsion direction of the excavator, surveying mechanism for surveying the propulsion direction of the excavator, the wiring cable and piping for supplying power source and oil pressure to the excavator and linking mechanism for linking and supporting pipes to be buried in the excavator.

To provide the excavator with propulsion force, the tail end of the pipe row to be buried linked behind the excavator may be pushed by a jack installed in the shaft, or propulsion shafts made of steel pipes or the like may be sequentially coupled inside the pipe row to be buried behind the excavator, and the tail end of the propulsion shafts may be pushed by the jack or the like. In this case, the pipe row to be buried may be pushed by the jack separately from the propulsion shafts, or the front end of the pipe row to be buried may be fixed to the excavator, and the pipe row to be buried may be towed along with the propulsion of the excavator. Besides, by holding and fixing the pipe row to be buried in the propulsion shafts passed inside, the pipe row to be buried may be propelled while promoting the propulsion shafts. Such method of holding and fixing the pipe row to be buried in the propulsion shafts and its practical structure are disclosed in the Japanese Official Patent Provisional Publications, Heisei 2-144498 and 3-047396, and others in detail.

The material of pipes to be buried may include Hume pipe, steel pipe, reinforced plastic pipe, vinyl chloride pipe, and other various piping materials used in ordinary propulsion process, and the applications of pipes to be buried are sewer, gas pipe, electric wire conduit, and other optional underground pipes.

The excavating mechanism may be only rotated as mentioned previously, but when the excavating mechanism is caused to perform eccentric rotation combining the rotation about the center of the excavating mechanism and the revolution about the center of the excavator, the removed soil may be efficiently compacted, or the frictional resistance applied from the soil may be reduced. The excavator for performing such an eccentric rotation in the excavating mechanism is disclosed in the Japanese Official Patent Provisional Publication, Showa 61-102999, and others. Such an excavator is said to be effective, because of the eccentric rotation of the excavating mechanism, not only for compacting the soil, but also for crushing the pebbles and stones.

In the prior art, the following mechanism is employed as the mechanical for eccentric rotation of the excavating mechanism by rotation of motor or the like. That is, the rotary shaft of the motor is bent in the midway, and the tip side is deviated from the axial center of the root side to form a so-called crankshaft, and a cutter assembly (excavating arm) and a rotary head (cone rotor) are attached to the tip of the crank shaft by way of rotary bearing. Behind the cone rotor, an outer gear is installed, while an inner gear slightly larger in the number of teeth than the outer gear and large in inside diameter is fixed to the excavator main body side. Since the crank shaft is eccentric as mentioned above, the outer gear is engaged inside the inner gear in a mutually off-center state. When the crank shaft rotates in this state, as the tip of the crank shaft moves while drawing a circle, the axial center of the excavating plate and cone rotor revolves. Besides, since the inner gear is engaged with the outer gear, the outer gear rotates and moves along the inner gear, and therefore the cone rotor and excavating arm rotate about the axial center, thereby performing eccentric rotation as mentioned above.

As an excavator for performing an eccentric rotation in the excavating mechanism, an excavator relating to the present invention and explained below is preferable.

That is, the present invention presents an excavator equipped, at a head of this main body, with an excavating mechanism possessing a drilling cutter and a compacting element for compacting the soil taken by the drilling cutter, wherein at least one part of the excavating mechanism having performed an eccentric rotation combining a rotation about an axial center of the excavating mechanism and a revolution about another center than the axial center; the excavator being characterized in that a tip part having a diameter larger than an outside diameter of a pipe to be buried and a rear part having a diameter nearly the same as the outside diameter of the pipe to be buried are arranged, in that the rotation transmission mechanism from the prime mover rotary shaft for driving the excavating mechanism to the excavating mechanism comprises a sun gear fixed on the prime mover rotary shaft, plural planet gears being disposed at equal intervals on the outer circumference of the sun gear and being engaged with the sun gear, and an inner tooth gear being fixed on the excavator main body and being engaged with the outer circumference of each planet gear, and in that the eccentric shaft disposed at a position eccentric from the axial center of the plural planet gears is linked to the excavating mechanism so as to rotate.

The basic structure of the excavator may be same as that of the excavator used in said various conventional propulsion methods. The head of the excavator is equipped with an excavating mechanism having so-called drilling edges such as tools and cutters for drilling the ground. The excavating mechanism is driven by a prime mover rotary shaft such as electric motor and hydropneumatic motor. The motor having the prime mover rotary shaft may be incorporated in the inner rear part of the excavator, or the prime mover rotary shaft may be driven by a motor installed in the shaft or on the ground surface, through a drive shaft passed through the inside of a tubular propulsion shaft for extending behind the excavator. When a screw conveyor for discharging soil is incorporated inside the propulsion shaft, the screw conveyor may be used as the drive shaft.

Behind the excavating mechanism, a soil discharge conveyor for conveying the excavated soil up to the shaft or the ground surface may be installed, or the excavated soil may be compacted to the ground side and filled back from the soil discharge port disposed in the outer wall of the excavator, so that the soil may not be discharged outside.

The excavating mechanism comprises an excavating arm or excavating plate having drilling edges as mentioned above, and a compacting element for compacting or transferring the excavated soil backward behind the excavating arm or the like. The compacting element is also known as cone rotor, and it has an approximately conical form tapered at the tip and getting thick backward. Practical examples of shape include truncated conical form, polygonal conical form, and cylindrical or polygonal tubular shape at the rear part of said conical forms. On the outer circumference of the compacting element, protrusions or undulations may be formed for grinding the soil finely or enhancing the backward transferring efficiency. Or when a screw plate is spirally wound around the compacting element, the soil transferring action and soil compacting action may be done smoothly. If the inner wall of the main body opposite to the compacting element is reversely tapered from the front side to the rear side, different from the compacting element, the soil is compacted efficiently. The compacting element, the excavating arm, and so on are driven by the prime mover rotary shaft.

As the rotation transmission mechanism from the prime mover rotary shaft to the excavating mechanism, the principle of so-called planet gear mechanism is employed. That is, on the prime mover rotary shaft, the sun gear is coupled and fixed, and a planet gear is engaged with the outside of this sun gear. Plural planet gears are disposed at equal intervals on the outer circumference of the sun gear. At least two planet gears are needed, but it is preferable to dispose three planet gears in a right triangular configuration from the viewpoint of load balance, or four or more planet gears may be also used. Inner gears are disposed in a state of engaging with the outside of each planet gear. The inner gear is fixed to the main body side. Each planet gear is supported by a bearing on the rear surface of the compacting element so as to rotate, and the motion of the entire planet gear is transmitted to the excavating mechanism such as the compacting element or the like.

In this way, a kind of planet gear mechanism is composed of the sun gear, planet gears and inner gears, and the excavating mechanism coupling the planet gears rotates at a specific ratio to the rotating speed of the prime mover rotary shaft. By properly setting the gear ratio of each gear, the rotating speed or the speed ratio transmitted from the primary mover rotary shaft to the excavating mechanism may be set freely. For example, if the number of teeth is same between the sun gear and planet gear, the excavating mechanism is rotated at $\frac{1}{4}$ speed of the rotating speed is the prime mover rotary shaft (the speed per unit time, same hereinafter). Such setting method of rotating speed is realized by the calculating method of gear ratio in the known planet gear mechanism, and it is enough to adjust the gear ratio of the sun gear and planet gear according to the necessary rotating speed ratio. However, when the axial center of the planet gear is directly coupled to the excavating mechanism, the excavating mechanism only rotates about the same center as the prime mover rotary shaft.

In the present invention, as the coupling structure of the planet gear and excavating mechanism, instead of coupling the axial center of the planet gear to the excavating mechanism, the eccentric shaft disposed at a position eccentric from the axial center of each planet gear is coupled to the rear surface of the compacting element of the excavating mechanism or the like so as to rotate. This coupling part of the eccentric shaft of the planet gear is the eccentric rotary part. This eccentric rotary part simultaneously performs the rotation about the axial center of the eccentric rotary part itself, and the revolution about the center of the prime mover rotary shaft, and such motion is called eccentric rotation. The speed of the rotation and revolution is determined by the gear ratio of the sun gear and planet gear. More specifically, for example, if the number of teeth is same between the sun gear and planet gear, the eccentric rotary part of the excavating mechanism rotates at a speed of $\frac{1}{4}$ of the prime mover rotary shaft, and revolves at $\frac{1}{2}$ thereof. By decreasing the rotating speed, the working torque can be increased. The ratio of the rotating speeds is automatically determined, regardless of the eccentric amount of the planet gear. By increasing the eccentric amount of the planet gear, the eccentric moving distance in the radial direction of the eccentric rotary part increases, and, for example, the transfer amount of the soil in the radial direction can be increased.

The eccentric rotary part may be the entire excavating mechanism including the compacting element and the excavating arm or the like, or only the compacting element may be the eccentric rotary part, or only a part of the compacting element may be the eccentric rotary part. Excluding the eccentric rotary part, the remaining portion of the excavating mechanism should be preferably the specific position rotary part for performing only ordinary rotation without being accompanied by eccentricity, by directly transmitting the rotation of the prime mover rotary shaft. When the excavating arm or the like is set in the specific position rotary part, deviation due to eccentricity of the excavating arm or the expansion of excavating range does not occur at the time of excavation of the ground by the drilling cutters, so that the drilling diameter may be set correctly. As mentioned above, when forming the soil discharge port on the outer wall of the excavator main body and compacting the soil to the ground side from it, it is desired to place at least the one corresponding to the soil discharge port, out of the compacting elements, in the eccentric rotary part so that the soil may be easily sent out in the radial direction from the discharge port. Of the compacting elements, in the position mainly responsible for action of sending soil backward, such as the front part near the excavating arm or the like, may be set in the specific position rotary part, instead of the eccentric rotary part.

As the tip large diameter part of the excavator is propelled by drilling the ground by a diameter larger than the outside diameter of the pipe to be buried by the excavator, since the outside diameter of the tip large diameter part is larger than the outside diameter of the rear part of the excavator and that of the pipe to be buried, a step difference or a gap is formed between the outside diameter of the tip large diameter part and that of the pipe to be buried. The soil is discharged into this gap formed behind the tip large diameter part, so that the soil may be discharged smoothly without receiving great resistance from the ground side, thereby covering the outside of the buried pipe row, so that the propulsion force required for propelling may be saved.

Besides, since the gap formed between the outside of the tip large diameter part of the excavator and the outside of the pipe to be buried may be utilized as a compaction space, a burying hole of a required diameter may be formed securely even if the propulsion force of the excavator or the compaction capacity is small, and unlike in the prior art, the applicable outside diameter of the pipe to be buried is not limited. This is described in detail while referring to FIG. 3.

Supposing the outside diameter of the front part of the excavator or the drilling diameter to be $D_1$, the outside diameter of the pipe to be buried or the inside diameter of the burying hole to be D, the possible compaction depth of ground to be t, and the volume decrease rate of the excavated soil by compaction to be $\alpha$, the sectional area of the gap allowed for discharging and compacting the removed soil is $$\pi(D_1+2t)^2/4-\pi D^2/4 \quad (5)$$

As compared with this gap, the volume of the soil that must be discharged and compacted is, considering the volume decrease rate, $$(1-\alpha)\pi D_{12}/4 \quad (6)$$

Accordingly, the following condition is required.

$$(1-\alpha)\pi D_{12}/4 \leqq \pi(D_1+2t)^2/4-\pi D^2/4 \quad (7)$$

Supposing $D_1=\beta D$, $t/D=\gamma$, the above formula may be rewritten as $$(1-\alpha)\beta^2 \leqq (\beta+2\gamma)-1 \quad (8)$$

Summing up the above expressions and considering the physical meaning, in the condition of $$\beta \geqq \{[4\gamma^2+\alpha(1-4\gamma^2)]^{0.5}-2\gamma\}/\alpha \quad (9)$$

perfect propulsion without soil discharge is realized. More specifically, for example, supposing the outside diameter of pipe to be buried $D=65$ cm, compression depth $t=5$ cm, and volume decrease rate $\alpha=0.1$, it means $\beta \geqq 1.944$, and it is enough to set the drilling diameter of the excavator at $D_1=126.4$ cm or more. Similarly, in the case of $t=8$ cm, $\alpha=0.15$, $D=100$ cm, it is enough to set the drilling diameter $D_1$ at around 170 cm at $\beta=1.696$.

Anyway, when the drilling diameter $D_1$ of the excavator is set properly according to the outside diameter D of the pipe to be buried and ground conditions, it is possible to propel without soil discharge securely, and the applicable outside diameter of the pipe to be buried is not limited theoretically unlike the conventional method. Besides, if the outside diameter of the pipe to be buried is the same, as compared with the conventional method, the degree of the compaction of the excavated soil may be smaller, and the energy required for compaction, that is, the driving force of the cone rotor or propulsion force may be saved, and the equipment cost and running cost of the propulsion mechanism and driving mechanism may be reduced.

In this process, as in the prior art, when the excavating mechanism is rotated eccentrically, the soil can be forced out in the radial direction from the discharge port by the force in the radial direction along with the eccentric rotation of the cone rotor, so that the soil may be compacted efficiently to the ground side. According to this improved process without soil discharge, a pipe may be buried efficiently at lower cost.

When the rotation of the prime mover rotary shaft of a motor or the like is transmitted to the excavating mechanism by the planet gear mechanism composed of sun gear, plural planet gears and inner gears, the rotation of the prime mover rotary shaft is decelerated at a specific ratio according to the principle of the planet gear mechanism, and is taken out as the rotation of the entire planet gears. When the axial centers of the plural planet gears are coupled to the excavating mechanism, the excavating mechanism also rotates along with the rotation of the entire planet gears. By this rotation alone, however, only the excavating mechanism is rotating at a specific position, and it is not the eccentric rotation combining rotation and revolution.

In the present invention, therefore, the eccentric shaft disposed at a position eccentric from the axial center of each planet gear is coupled to the excavating mechanism. The eccentric shaft, aside from the rotation of the entire planet gears, revolves about the axial center of the planet gear along with the rotation of the individual planet gears. As a result, having the eccentric shaft of each planet gear at the peak point, a virtual polygonal shape centered about the axial center of the sun gear will revolve about the axial center of the sun gear, while rotating itself, without changing its shape. Since each eccentric shaft is coupled to the eccentric rotary part of the excavating mechanism so as to rotate, the motion of the virtual polygonal shape linking the eccentric shafts of the planet gears is directly transmitted to the motion of the eccentric rotary part. In consequence, the motion of the eccentric rotary part becomes a combination of the revolution about the center of the sun gear, that is, the prime mover rotary shaft, at the equal rotating speed to the rotation of the individual planet gears, and the rotation about the axial center of the excavating mechanism accompanying the rotation of the entire planet gears. Thus, the eccentric rotary part of the excavating mechanism forms the combined motion of rotation and revolution, that is, the eccentric rotation.

The ratio of the speed of rotation and revolution of the eccentric rotary part and the rotating speed of the prime mover rotary shaft may be calculated theoretically from the principle of the planet gear mechanism on the basis of the number of teeth of sun gear and planet gear. For example, supposing the number of teeth of sun gear to be $Z_1$, and the number of teeth of planet gear to be $Z_2$, the speed of the revolution of the eccentric rotary part per one rotation of the prime mover rotary part is $Z_1/2Z_2$, and the speed of rotation of the eccentric rotary part is $-Z_1/\{2\ (Z_1+Z_2)\}$ (where the minus sign denotes reverse rotation). Therefore, by adjusting the values of $Z_1$ and $Z_2$, the speed of rotation and revolution of the eccentric rotary part may be set as desired. Besides, since the eccentric amount of the eccentric shaft of the planet gear is equal to the eccentric amount at the time of revolution of the eccentric rotary part, that is, the radius of revolution, the radius of revolution of the eccentric rotary part may be freely adjusted by the eccentric amount of the eccentric shaft.

According to the propulsion method of a pipe to be buried without soil discharge as described herein, the soil removed by drilling the ground by a diameter larger than the outside diameter of the pipe to be buried is discharged and compacted to the ground side by making use of the gap formed between the tip large diameter part of the excavator and the outside diameter of the pipe to be buried, so that the soil may be discharged and compacted very smoothly. In particular, only by properly selecting the tip large diameter part of the excavator and the drilling diameter according to the outside diameter of the pipe to be buried, pipes of any diameter can be easily buried progressively, and therefore the propulsion method of a pipe to be buried without soil discharge can also be applied to pipes of medium and large diameter, in which the conventional propulsion method without soil discharge could not be applied.

Also according to the excavator of the present invention, at least a part of the excavating arm, excavating plate, cone rotor and other excavating mechanisms is designed in an eccentric rotation mechanism for eccentrically rotating the eccentric rotary part, and a kind of planet gear mechanism is composed of sun gear, plural planet gears and inner gears, and the eccentric shaft eccentric from the axial center of the planet gear is coupled to the eccentric rotary part so as to rotate, and therefore the motion of the eccentric rotary part may be freely set, particularly in the speed of revolution.

More specifically, the rotating speed of the eccentric rotary part is set lower than the rotating speed of the motor to increase the rotary torque, thereby increasing the compacting force by the cone rotor so as to compact the soil efficiently and enhance the working efficiency of tunnel excavation, and the rotating speed of the eccentric rotary part, in particular, the speed of revolution can be set freely, so that the eccentric rotary part can perform adequate motions corresponding to the installation conditions such as the soil property of the ground or the like. Unlike the conventional excavator, since it is not necessary to mount a reduction gear apparatus, separately from the eccentric rotary mechanism, on the rotary shaft of the motor, structure of the entire excavator can be simplified and down-sized. As a result, it is possible to exhibit an excellent performance as an excavator especially for a tunnel of a small aperture.

DESCRIPTION OF THE PREFERRED EMBODIMENTS

Figure 1:
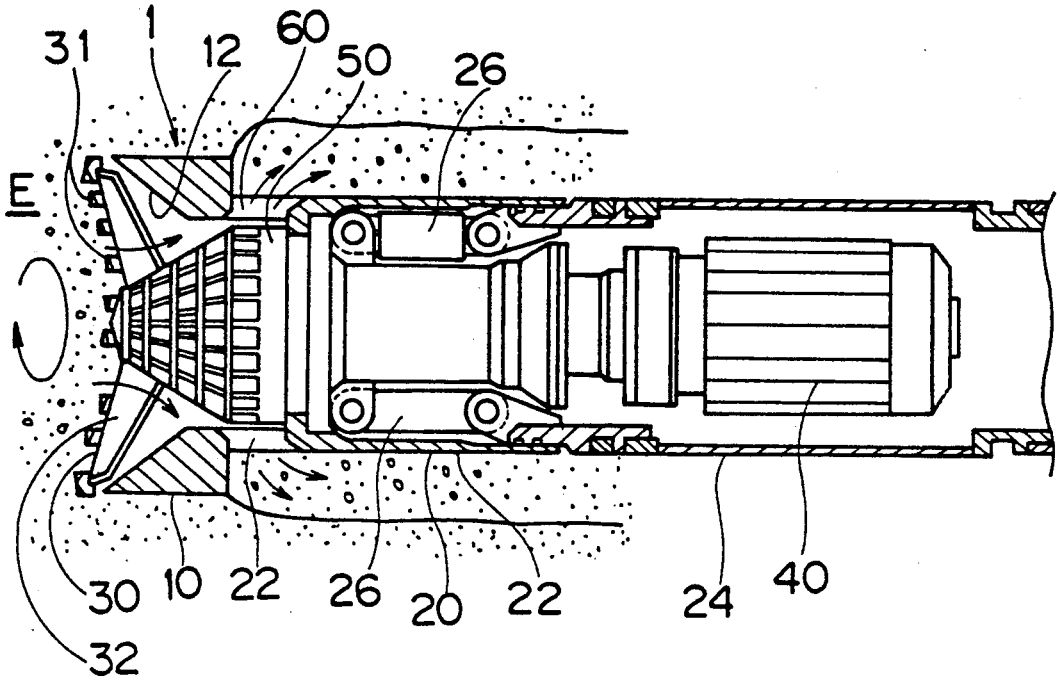
FIG. 1 is a sectional view of installation state showing an embodiment of a propulsion method of the present invention.

Referring now to the drawings, some of the embodiments of the present invention are described in detail below.

FIG. 1 shows the structure of the excavator area in a state of installation, in which the excavator 1 propelling in the ground E comprises a tip large diameter part 10 and a rear part 20 smaller in outside diameter than the tip large diameter part 10.

The tip of the tip large diameter part 10 is equipped with an excavating mechanism 30 having multiple tools 31. The excavating mechanism 30 is rotated and driven by a motor 40 installed behind. A soil intake port 32 is opened in the excavating mechanism 30, and the removed soil is taken into the excavator 1.

Behind the excavating mechanism 30 a cone rotor 50 is installed, and it is rotated and driven by the motor 40 same as the excavating mechanism 30. The cone rotor 50 has a conical form in which its tip is pointed. The inner circumference 12 of the tip large diameter part 10 of the excavator 1 covering the outer circumference of the excavating mechanism 30 and cone rotor 50 is formed in a reverse conical form, tapered toward the rear side, from the cone rotor 50. Therefore, the soil sent behind the excavating mechanism 30 moves to the narrower rear side in the tapered gap enclosed between the inner circumference 12 of the tip large diameter part 10 and the cone rotor 50. The cone rotor 50 is installed slightly eccentrically from the rotary shaft of the motor 40, and the entire cone rotor 50 rotates eccentrically. Accordingly, the soil sent backward along the outer circumference of the cone rotor 50 receives a force in the radial direction along the eccentric rotation of the cone rotor 50. Through such process, the soil and pebbles are crushed finely and compacted.

Immediately behind the step difference part of the tip large diameter part 10 of the excavator 1 and the rear part 20, a rear soil discharge port 60 is opened on the outside of the rear part 20. The soil moving behind along the cone rotor 50 is discharged to the ground side from the rear soil discharge port 60. The discharged soil is compacted as being put into the gap formed between the outside of the tip large diameter part 10 and the outside of the rear part 20, and a burying hole corresponding to the outside diameter of the pipe to be buried (not shown) connected behind the rear part 20 is formed.

The rear part 20 of the excavator 1 is flexibly coupled with the front tube part 22 fixed to the tip large diameter part 10 and the rear tube part 24 coupling the pipe row to be buried, by means of a direction control jack 26, so that the front tube part 22, that is, the tip large diameter part 10 and the excavating mechanism 30 are free to swivel, and therefore the propulsion direction may be corrected easily.

When burying a pipe progressively by using the excavator 1 having such structure, the soil removed by drilling the ground in a range corresponding to the outside diameter of the tip large diameter part 10 by the excavating mechanism 30 is taken into the excavator 1 from the soil intake port 32 of the excavating mechanism 30. The soil is sent backward along the cone rotor 50, and is forced in the outer circumferential direction by the eccentric rotation of the cone rotor 50. The soil sent up to the rear soil discharge port 60 is sent out into the gap formed in the step difference between the tip large diameter part 10 and the rear part 20. When compacted to a specific thickness of the removed soil and the inner wall of the ground, the entire excavated soil is completely compacted in the outer circumferential part of the pipe to be buried. Thus, as the excavator 1 is promoted, the pipe is buried progressively in the burying hole formed behind the excavator 1, and the soil excavated by the excavator 1 is completely filled back into the outer circumferential part of the buried pipe.

Figure 2:
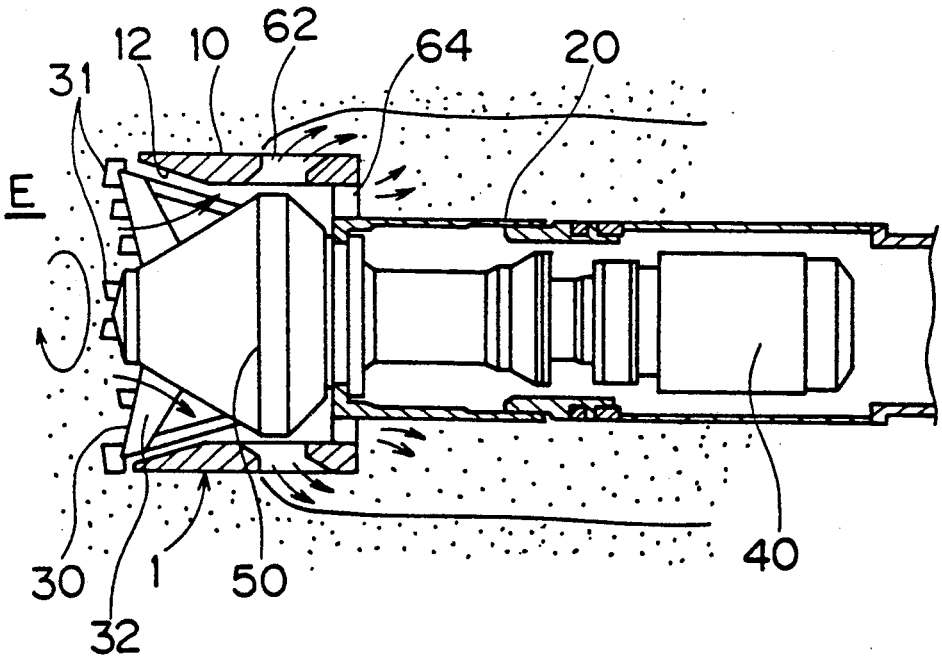
FIG. 2 is a sectional view of installation state showing other embodiment of the present invention.
Figure 3:
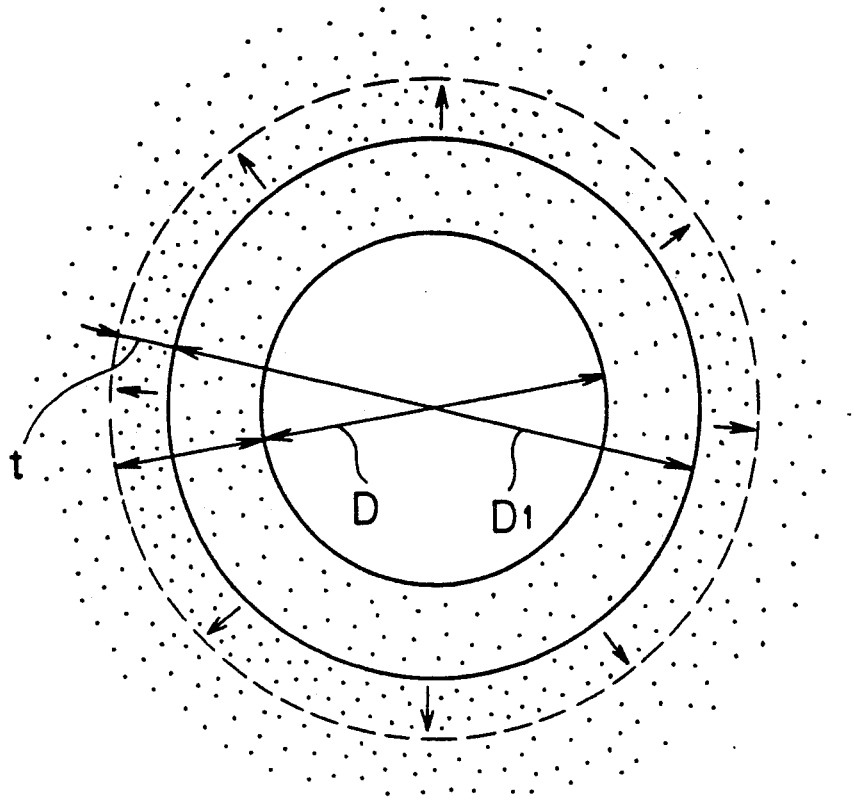
FIG. 3 is a sectional view of a burying hole for explaining the state of compaction of the soil in a propulsion method of the present invention.
Figure 4:
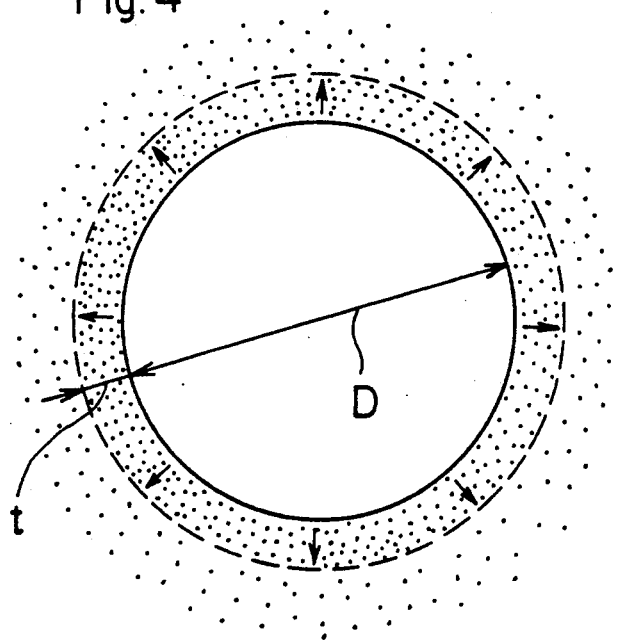
FIG. 4 is a sectional view of a burying hole for explaining the state of compaction of the soil in a conventional method.

In other embodiment shown in FIG. 2, the structure of the soil discharge port is different from that in the preceding embodiment. In this embodiment, an axial soil discharge port 64 opening behind in the axial direction of the excavator 1 is formed in the vertical wall part existing in the step difference part between the tip large diameter part 10 and the rear part 20. The soil sent out from the axial soil discharge port 64 backward is discharged smoothly because the resistance from the ground becomes smaller. In this embodiment, moreover, there is an outermost soil discharge port 62 opening on the outer circumference of the tip large diameter part 10, that is, on the outermost surface of the excavator 1. Therefore, of the soil removed by the excavating mechanism 30, a part is discharged from the axial soil discharge port 64, while a part of the remainder is discharged from the outermost soil discharge port 62.

Figure 5:
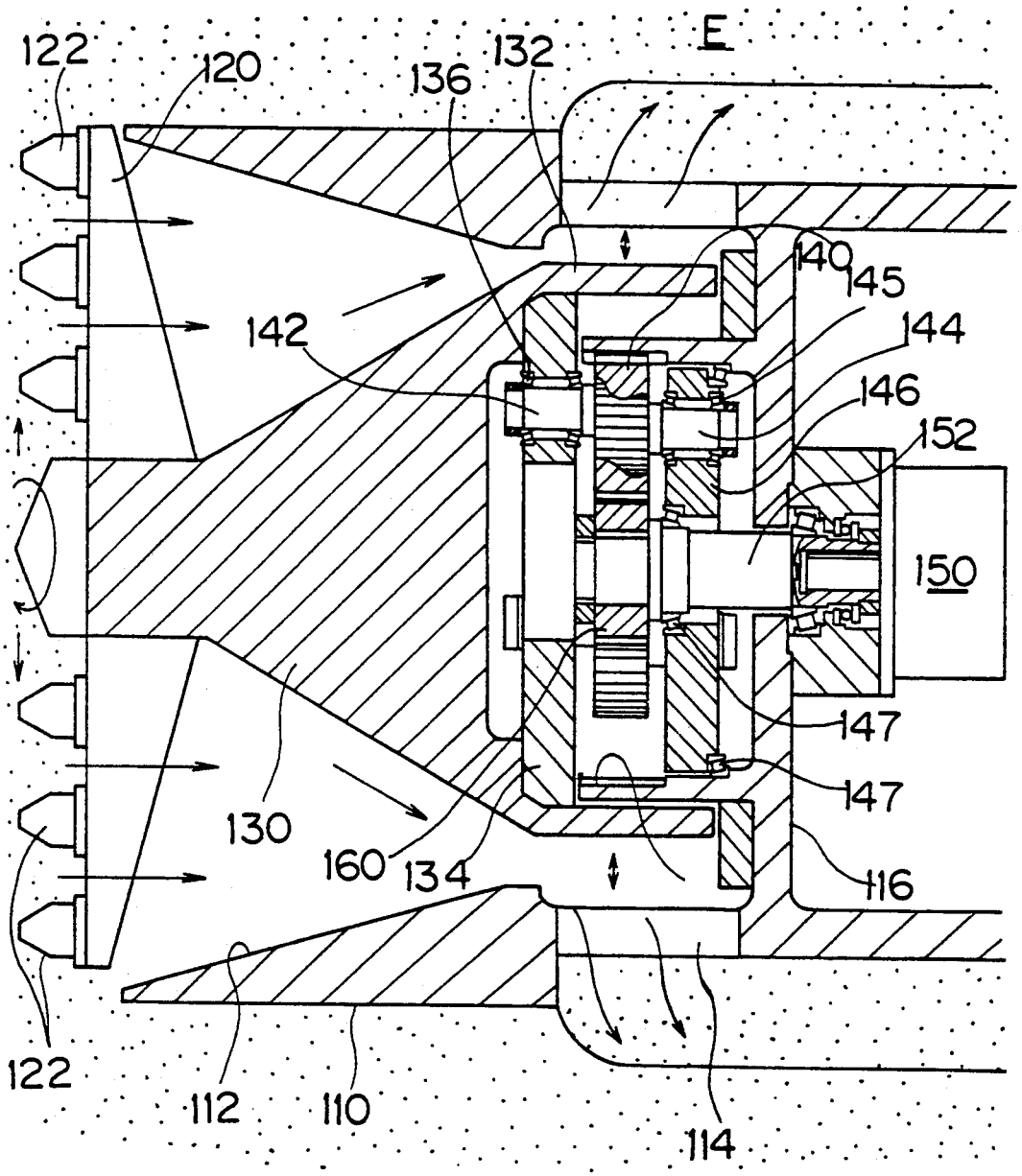
FIG. 5 is a sectional view of installation state showing an embodiment of an excavator of the present invention.
Figure 6:
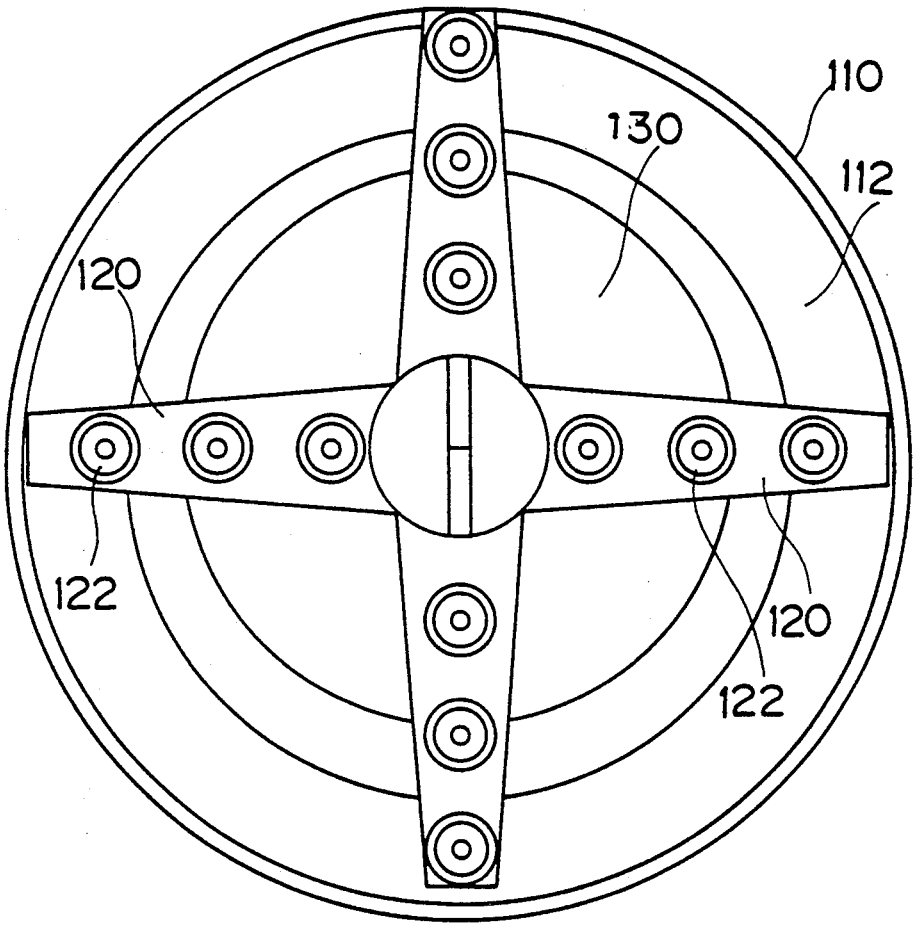
FIG. 6 is a front view as seen from the excavating edge side.
Figure 7:
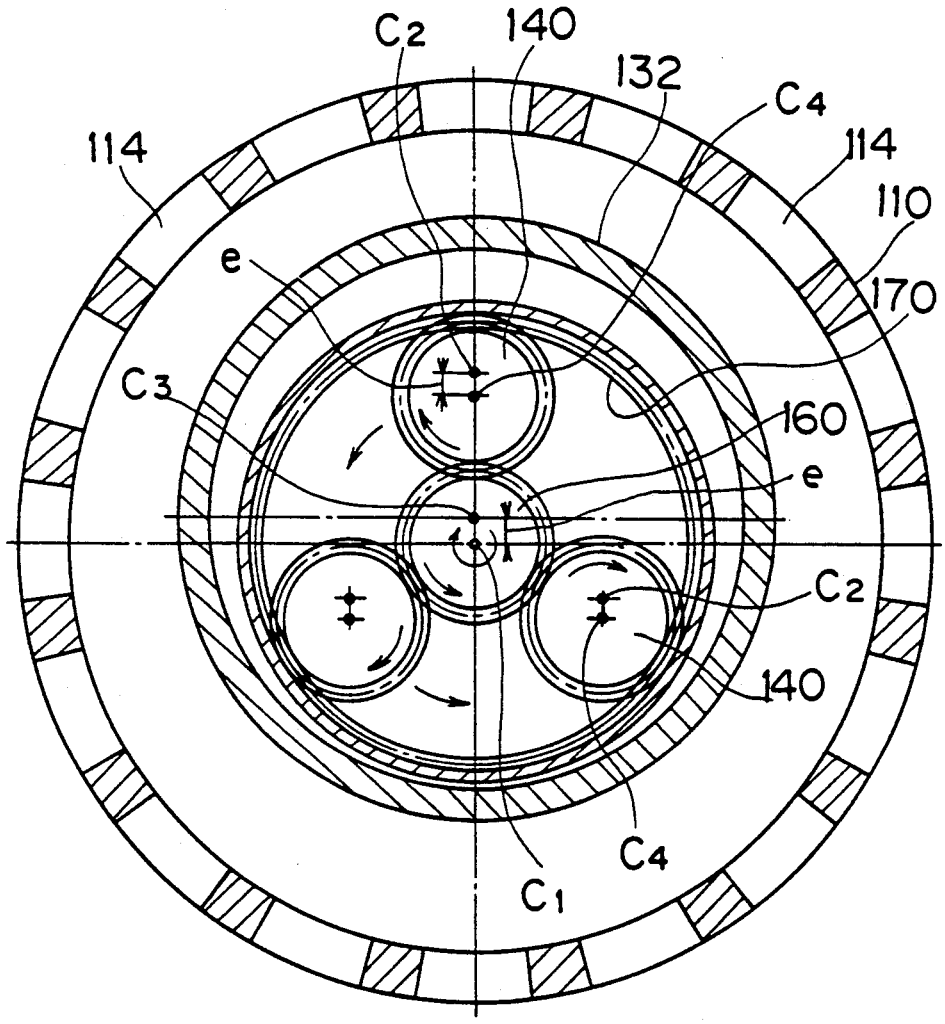
FIG. 7 is a sectional view of the planet gear mechanism area.

FIG. 5 to FIG. 7 represent the entire structure of a preferred embodiment of the excavator relating to the present invention. At the head of a cylindrical main body 110, an excavating arm 120 extending in four directions from the center is disposed, and multiple drilling edges 122 such at tools and cutters are attached to the front side of the excavating arm 120. The excavating arm 120 is integrally fixed to the tip of a cone rotor 130 as the compacting element, and the cone rotor 130 is incorporated in the main body 110. The cone rotor 130 is in a truncated conical form tapered at the tip and extending toward the rear side, and the rear end of the cone rotor 130 is a straight cylindrical part 132. The inner wall 112 of the main body 110 opposite to the tapered part of the cone rotor 130 is a conical hole wider at the tip side nearer to the excavating arm 120 and narrower toward the rear side like taper. In the position of the main body 110 opposite to the cylindrical part 132 of the cone rotor 130, multiple soil discharge ports 114 are penetrated and formed at equal intervals in the circumferential direction. The excavated soil is returned to the ground E side from these soil discharge ports 114, and are compacted and filled back to the ground E.

Behind the cone rotor 130, deep inside the inner wall 116 of the main body 110, a motor 150 is fixed, and a rotary shaft 152 of the motor 150 is extended forward in the center of the main body 110 through the inner all 116, and this rotary shaft 152 serves as the prime mover rotary shaft.

A sun gear 160 is mounted and fixed on the prime mover rotary shaft 152. On the outer circumference of the sun gear 160 three planet gears 140 are disposed i a right triangular configuration at equal intervals on the circumference, and are engaged with the sun gear 160. The planet gears 140 and the sun gear 160 are set in the same number of teeth. At the back side of the planet gear 140 near the motor 150, a support shaft 144 projecting in the axial center is disposed. The support shaft 144 is supported by a support plate 146 through a bearing 145 so as to rotate, and the support plate 146 is supported by the prime mover rotary shaft 152 penetrating through the center so as to rotate, and the inner wall 116 on the outer circumference, through a bearing 147. At the front side of the planet gear 140 nearer to the cone rotor 130, an eccentric shaft 142 is disposed, which projects eccentrically at the position slightly remote from the axial center.

Figure 8:
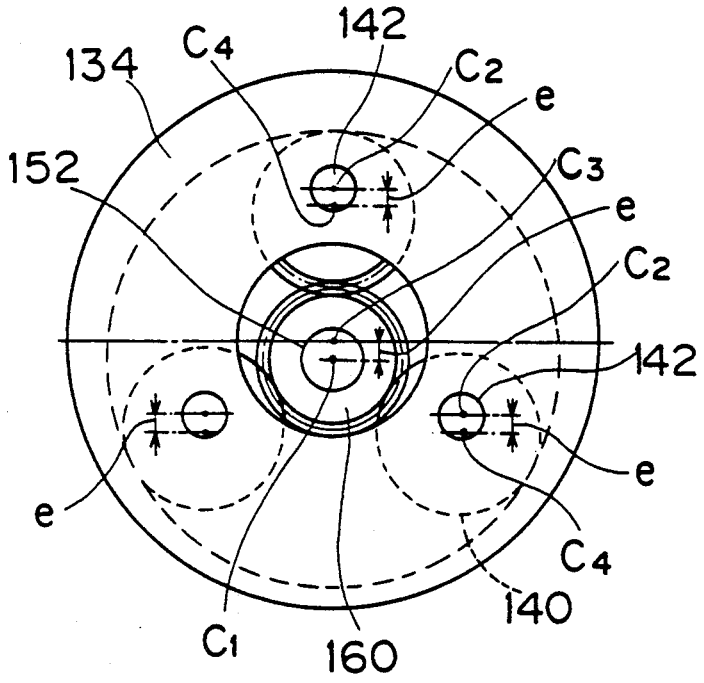
FIG. 8 is a schematic structural diagram of only the vicinity of the bearing plate.

Inside the cylindrical part 132 of the cone rotor 130 a bearing plate 134 is fitted. As shown in FIG. 8, the bearing plate 134 is disk-shaped. The eccentric shaft 142 of the planet gear 140 is coupled to the bearing plate 134 through a bearing 136 so as to rotate. Each eccentric shaft 142 is located at a position equal in distance in the radial direction from the center of the bearing plate 34. The center $C_2$ of the eccentric shaft 142 of the planet gear 140 is eccentric from the axial center $C_4$ of the planet gear 140 by distance e, and therefore the bearing plate 134 is eccentrically installed in the eccentric amount e with respect to the sun gear 160 which is the center of the plural planet gears 140. In other words, with respect to the center $C_1$ of the prime mover rotary shaft 152 and the main body 110, the center $C_3$ of the bearing plate 134, cone rotor 130 and excavating arm 120 is eccentric by e.

The outer circumference of the planet gear 140 is engaged with an inner gear 170 projected from the inner wall 116 of the main body 110. This inner gear 170, and the planet gears 140 and the sun gear 160 are combined to compose the planet gear mechanism.

The excavating system comprises, besides the above structures, various mechanisms same as used in the ordinary excavator as required, although not shown in the drawings, such as the mechanism for coupling, to the rear side, the propulsion shafts or pipes to be buried, the deflecting mechanism for adjusting the drilling direction of the excavator, the surveying mechanism for surveying excavating direction, and operating power and oil pressure supplying mechanism for individual units.

The operation of thus composed excavator is explained below.

The rotation of the motor 150 is transmitted from the prime mover rotary shaft 152 to the sun gear 160. The rotation of the sun gear 160 is transmitted to the cone rotor 130 by way of the bearing plate 134 from the eccentric shaft 142 of the planet gear 140 through the action of the planet gear mechanism comprising the planet gears 140 and the inner gear 170. According to the principle of the planet gear mechanism, the speed of the rotation of the planet gear 140 is ½ of the rotating speed of the prime mover rotor shaft 152 and is reverse to the rotation of the prime mover rotary shaft 152, and the speed of revolution of the entire assembly of the plural planet gears 140 is ¼ of the rotating speed of the prime mover rotary shaft 152, and is same as the direction of rotation of the prime mover rotary shaft 152. The revolution of the planet gear 140 is converted to the rotation about the axial center of the bearing plate 134, and the rotation of the planet gear 140 is the revolution of the bearing plate 134 about the primary mover rotary shaft 152, and therefore the rotation of the bearing plate 134 and cone rotor 130 is the revolution in the same direction as the prime mover rotary shaft 152 at a rotating speed of ½ of the prime mover rotary shaft 152, and is the rotation in the reverse direction of the prime mover rotary shaft 152 at a rotating speed of ¼ of the prime mover rotary shaft 152. The combined motion of the rotation and revolution is the so-called eccentric rotation.

As the cone rotor 130 and the excavating arm 120 perform such eccentric rotation as described above, first the ground E is excavated by the excavating edge 122 of the excavating arm 120. The soil taken into the main body 110 through the gap in the excavating arm 120 is moved backward in the tapered space between the outer surface of the cone rotor 130 and the inner wall 112 of the main body 110, and is gradually compacted. Besides, since the cone rotor 130 is rotating eccentrically, the width of the space between the outside of the cone rotor 130 and the inner wall 112 of the main body 110 varies periodically. When this space is expanded, the soil is smoothly taken in, and the soil taken in when closing the space is compacted, so that the soil is compacted efficiently, while the soil resistance is small.

As the soil is moved up to the cylindrical part 132 of the cone rotor 130, by the eccentric rotation of the cone rotor 130, the soil is pushed outward, and is discharged outside the main body 110 from the soil discharged ports 114. The soil is pushed in and compacted in the ground E, and a part of the ground E around the main body 110 is also compacted simultaneously, so that the soil may be completely filled back to the ground E side. As a result, in this excavator, without discharging the soil into the shaft or above the ground surface, it is possible to excavate without discharging soil, and therefore the soil discharging conveyor and others are not required.

Figure 9:
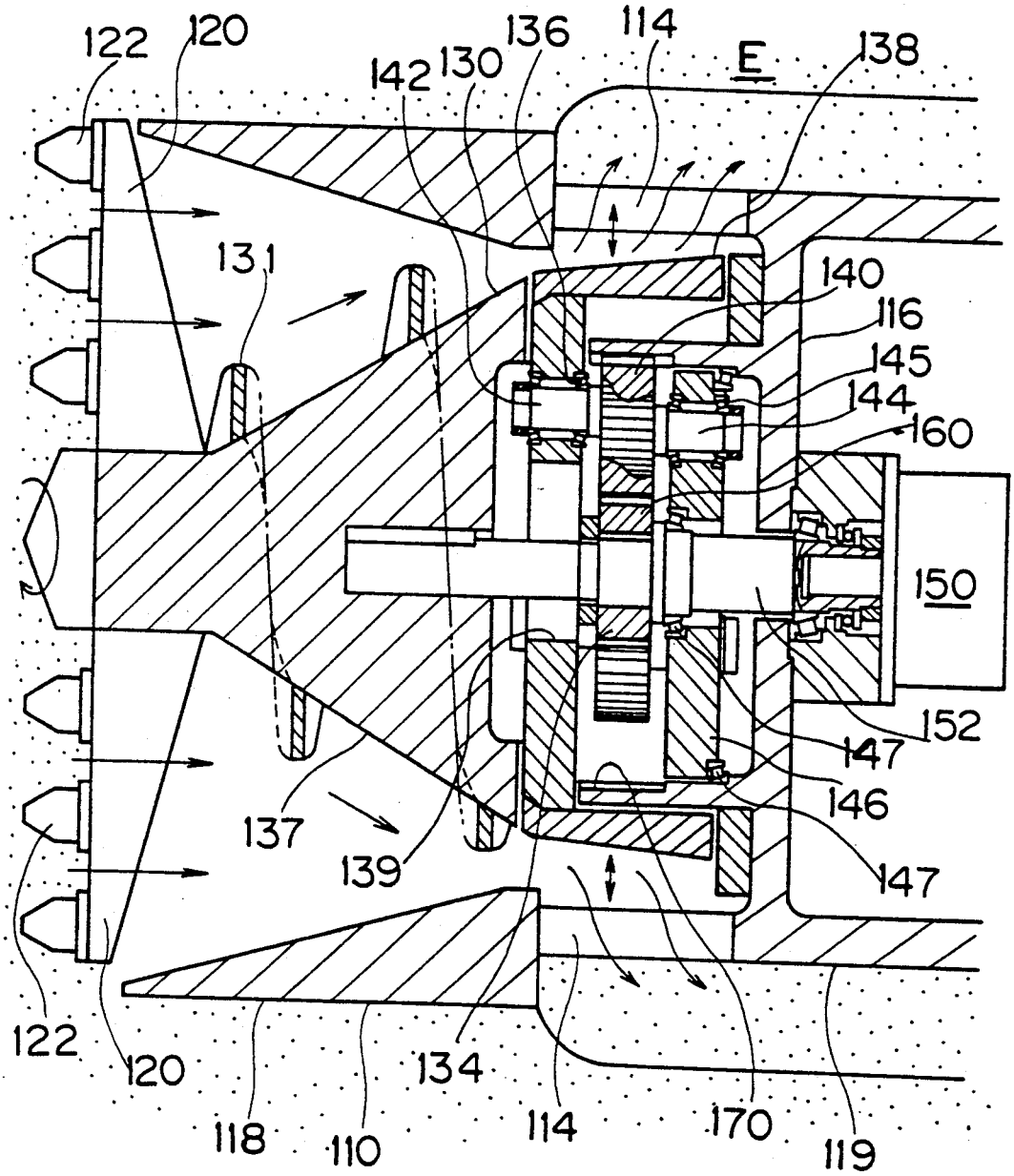
FIG. 9 is a sectional view of installation state showing a different embodiment of the present invention.

FIG. 9 shows an excavator partly different in structure from the foregoing embodiment. In the preceding embodiment, the excavating arm 120, and the cone rotor 130 as the compacting element, that is, the entire excavating mechanism is rotated eccentrically, but in this embodiment, only the rear end part 138 which is a part of the cone rotor 130 is rotated eccentrically. Accordingly, the cone rotor 130 is divided into the front part 137 which is integral with the excavating arm 120, and the rear end part 138 at the position opposite to the soil discharge ports 114 of the main body 110. A bearing plate 134 is fitted to the inside of the rear end part 138, and the eccentric shaft 142 of the planet gear 140 is coupled so as to rotate. The prime mover rotary shaft 152 is extended forward, and is fitted and fixed by engagement or the like at the front part 137 of the cone rotor 130 through a penetration hole 139 formed in the middle of the bearing plate 134. As a result, the front part 137 of the cone rotor 130 and the excavating arm 120 rotate at a specific position in union with the prime mover rotary shaft 152, without rotating eccentrically.

Thus, when the front part 137 of the cone rotor 130 and the excavating arm 120 rotate at specific position, the drilling diameter of the ground E by the excavating arm 120 can be set accurately. Besides, since the excavating arm 152 rotates at high speed as the prime mover rotary shaft 152, there is an advantage that the drilling efficiency is enhanced at the same time.

In this embodiment, a screw plate 131 is spirally wound around the outer circumference of the front part 137 of the cone rotor 130. This screw plate 131 can efficiently move the soil backward or compact. Besides, the rear end part 138 is not a flat cylindrical form, but is tapered, extending backward.

Furthermore, the main body 110 has a step difference in the outside diameter, between the front part 118 closer to the excavating arm 120 and the rear part 119 including the soil discharge ports 114. That is, the outside diameter of the rear part 119 is set at the diameter of the pipe to be buried, or the inside diameter of the tunnel to be excavated, while the outside diameter of the front part 118 is set slightly larger than the outside diameter of the rear part 119. In this setting, after drilling a large hole by the front part 118, the soil is filled back from the soil discharge ports 114 into the space in the gap between this large excavated hole and the outside of the rear part 119, and therefore the resistance receiving from the ground E is small when filling back the soil, so that the soil may be filled back smoothly. What is more, after once excavating the ground E in a wide range, the soil is compacted and filled back to the wide space at the outer side, and therefore the thickness of the ground E responsible for compaction of the soil is increased, and it is possible to compact a large volume of soil even at a same compacting degree, so that the aperture of the hole to be excavated without discharging the soil to the ground surface can be widened.

What is claimed is:

1. A propulsion method for burying a pipe without solid discharge, the method comprising the steps of drilling ground which contains soil with the tip of an excavator propelling within the ground to form a hole, taking the drilled soil into the excavator, discharging the taken soil to the ground side by compacting the soil on the outer circumference of the excavator, and burying the pipe progressively in the hole formed behind the excavator; the excavator including a front tip part having a diameter larger than the outside diameter of the pipe to be buried and a rear part having a diameter nearly the same as the outside diameter of the pipe to be buried and smaller than the diameter of the front tip part such that the hole in the ground is drilled to a diameter larger than the outside diameter of the pipe, and at least a portion of the soil taken into the excavator is discharged outside of the excavator in a position to the rear of the tip part of the excavator.

2. A propulsion method of burying a pipe without soil discharge as claimed in claim 1, wherein the excavator includes a cone rotor inside the excavator which is capable of rotating eccentrically in a soil passing portion of the excavator.

3. An excavator comprising a main body with an excavating mechanism at the head of the main body which includes a drilling cutter and a compacting element for compacting soil taken by the drilling cutter, at least one portion of the excavating mechanism capable of performing an eccentric rotation combining a rotation about an axial center of the excavating mechanism and a revolution about a center other than the axial center; the excavator further including a tip part having a diameter larger than an outside diameter of a pipe to be buried and a rear part having a diameter nearly the same as the outside diameter of the pipe to be buried, the excavator further including a rotation transmission mechanism coupling a prime mover rotary shaft for driving the excavating mechanism to the excavating mechanism, the rotation transmission mechanism comprising a sun gear fixed on the prime mover rotary shaft, plural planet gears disposed at equal intervals on the outer circumference of the sun gear and engaged with the sun gear, and an inner tooth gear fixed on the excavator main body and engaged with the outer circumference of each planet gear, and an eccentric shaft disposed at a position eccentric from the axial center of the plural planet gears and linked to the excavating mechanism so as to rotate.

* * * * *